United States Patent [19]

Steinberg et al.

[11] 4,172,968

[45] Oct. 30, 1979

[54] ELECTRICAL SYSTEM

[75] Inventors: Bernard D. Steinberg, Philadelphia, Pa.; Robert C. Hilliard, Hampton Falls, N.H.

[73] Assignee: General Atronics Corporation, Philadelphia, Pa.

[21] Appl. No.: 158,647

[22] Filed: Dec. 8, 1961

[51] Int. Cl.[2] ..... H04K 1/02

[52] U.S. Cl. ..... 179/1.5 R; 178/22; 325/33

[58] Field of Search ..... 179/1.5, 1.5 R; 178/22; 325/33, 40

[56] References Cited

U.S. PATENT DOCUMENTS

| | | | |
|---|---|---|---|
| 1,395,378 | 11/1921 | Wilson et al. | 325/33 |
| 1,598,673 | 9/1926 | Blackwell et al. | 179/1.5 R X |
| 1,632,099 | 6/1927 | Schelleng | 179/1.5 C X |
| 2,405,991 | 8/1946 | Beverage et al. | 179/1.5 R X |
| 2,993,089 | 7/1961 | Negri | 178/22 |

*Primary Examiner*—Richard A. Farley

*Attorney, Agent, or Firm*—Thomas A. Briody; William J. Streeter; William J. Iseman

EXEMPLARY CLAIM

1. In a secure communication system; means for producing an analog intelligence signal; means for limiting the amplitude of said signal; means for transforming portions of said amplitude limited signal occurring in time sequence into a corresponding digital signal consisting of sequentially occurring n-digit words; means for combining said digital signal with a digital keystream signal in modulo $2^n$ fashion; and means for transforming the digital signal produced by said combining means into an analog signal.

20 Claims, 8 Drawing Figures

12.5 MS
312.5 μsec
1
2
3
4
38
39
40
41
42
78
79
80
81
82
118
119
120

12.5 MS
1
41
81

2
42
82

40
80
120

15
TO DE-CRYPTER
16
ADDER
64

62
40-STAGE SHIFT REGISTER
BAL GATE
$61_1$
$61_2$
$61_{39}$
$61_{40}$
HOLDING SAMPLER
$57_1$
$57_2$
$57_{39}$
$57_{40}$
63
(3.2 KC)
INTE-GRATOR
$54_1$
$54_2$
$54_{39}$
$54_{40}$
QUENCH
$58_1$
$58_2$
$58_{39}$
$58_{40}$
DELAY
60
GATE
$55_1$
$55_2$
$55_{39}$
$55_{40}$
PULSE FORMER
59
BAL DEMOD
$51_1$
$51_2$
$51_{39}$
$51_{40}$
PHASE SHIFTER (+45°)
$52_1$
$52_{20}$
PHASE SHIFTER (-45°)
$53_1$
$53_{20}$
LOCKED OSC ($f_1$)
$50_1$
LOCKED OSC ($f_{20}$)
$50_{20}$
56
(80 CPS)
FROM TELEPHONE LINE

ELECTRICAL SYSTEM

The present invention relates to encrypted transmission of intelligence. Encryption is a process wherein an electrical signal having as nearly random variations as possible is combined with a signal having intelligence representative variations. At the receiver a signal identical to the random signal mentioned above is combined in inverse fashion with the received signal. The presence of the random variations in the transmitted signal renders this signal "secure", i.e. immune to analysis for the intelligence representative variations contained therein, by anyone who does not have access to a means for generating the particular random signal necessary to recover this intelligence.

While not limited thereto, the invention is particularly applicable to the encrypted transmission of speech and will be described with reference to such transmission.

When a speech representative signal is encrypted, there is removed the high degree of correlation existing in this signal between successive portions thereof representing successive speech sounds. It is this correlation which makes it possible to transmit a speech representative signal over a channel, such as a conventional telephone line, having greatly restricted bandwidth compared to the full frequency range of ordinary speech, without appreciably impairing either the intelligibility of the speech, or those other qualities thereof which make identification of the speaker possible.

To obtain natural speech reproduction with speech signals from which the correlation had been removed by encryption, it was heretofore deemed necessary to employ a transmission channel for the encrypted signals whose bandwidth was many times wider than that of an ordinary telephone line. By using such a channel it was possible to transmit the encrypted, decorrelated signals with substantially none of the distortion to which they would be subject in an ordinary telephone line. This method indeed made it possible to reproduce the original speech signal with adequate fidelity at the receiver. However it could not be practiced without exceeding greatly the bandwidth of ordinary telephone lines. This made it impossible to use the existing telephone networks of this and other countries for satisfactory "secure" telephone communication and required, instead, the use of special facilities, expressly installed and maintained for this purpose. Such special facilities are so extremely expensive that the use of secure telephone communications has heretofore remained far below the level which optimum operation efficiency would require.

Accordingly, it is a primary object of the invention to provide an improved system for the encrypted transmission of intelligence.

It is another object of the invention to provide an improved system for the encrypted transmission of speech.

It is another object to provide a system for the encrypted transmission of speech which requires no more bandwidth than unencrypted speech.

It is another object to provide a system for the encrypted transmission of speech which is capable of using a conventional telephone line.

It is another object to provide a system of encrypted speech transmission in which the speaker is identifiable despite the fact that the channel through which the encrypted speech signal is transmitted has a bandwidth too narrow to transmit the signal in conventional fashion without substantial distortion.

In accordance with the invention, these objects, and others which will appear, are achieved as follows.

The signal to be transmitted is prepared for application to an ordinary telephone line by means of equipment which transforms a plurality of portions, or samples of the signal occurring in time-sequence during a predetermined interval (called a "frame") into a corresponding number of carrier waves, all occurring simultaneously over an interval substantially as long as one frame. The carrier waves are grouped in pairs, each pair being at a different frequency from every other pair, and the members of each pair being at the same frequency, but in mutual phase quadrature relation. The amplitude of each carrier wave is proportional to the amplitude of the portion, or sample of the time-sequential signal to which it corresponds. The frequencies of the different pairs of carrier waves are spaced substantially equally within the frequency band which the telephone line is capable of transmitting.

The time-sequential signal, which is transformed as described above, is the speech signal to be transmitted, modified not only by encryption, but also, prior to encryption, by limitation of its amplitude excursions in a manner explained hereinafter.

For security reasons, encryption is required to be performed by combination of the random noise signal with the intelligence signal in "modulo r" fashion, where r is equal to at least two of whatever units the magnitudes of both said signals are expressed in. As is well known, combination "modulo r" means that the signal resulting from the combination is equal to the remainder left after r has been subtracted as many times as possible from the arithmetic combination of the two signals in question. For example, the "modulo 10 volts" sum of a 30 volt and a 15 volt signal is 5 volts. This is the remainder left after the 10 volt modulus has been subtracted four times from 45 volts, which is the arithmetic sum of the original signals. Because of this required method of combination it is possible for the encrypted signal, both before and after its transformation into the plural-carrier form described above, to assume widely disparate values in response to small changes in the unencrypted signal and, conversely, for the encrypted signal to vary only slightly in response to wide variations in the unencrypted signal. Moreover small, unintended deviations in the amplitudes of the plural transmitted carriers, such as occur inevitably because of noise in the transmission medium, can produce changes which are indistinguishable from those produced by very substantial changes in the amplitude of the unencrypted signal. These noise-produced changes therefore tend to interfere seriously with the proper reproduction of the original speech signal at the receiver. We have recognized that these noise-produced changes occur more frequently, for any given noisiness of the transmission medium, as the amplitude of the unencrypted signal approaches the maximum amplitude of the noise signal which is combined with the unencrypted signal for purposes of encryption.

In accordance with the invention, therefore, there is provided, ahead of the encrypting apparatus, the signal amplitude limiting means referred to previously, which functions to prevent amplitude excursions of the unencrypted speech signal from approaching said maximum amplitude of the encryption signal. The presence of this limiting means reduces the frequency with which the transmitted signal is disturbed by the presence of noise in the transmission medium. This reduction, in turn, produces an improvement in the identifiability of speech conveyed by the system which is out of all proportion to any loss in fidelity of peak speech volume reproduction caused by the use of the amplitude limiting means.

At the receiver end of the system the plural carriers placed on the telephone line at the transmitter are transformed back into a time-sequential signal corresponding to that employed to generate these carriers as previously explained. The same noise signal which was combined with the speech signal for encryption purposes at the transmitter is then eliminated, in the same modulo r fashion in which it is introduced at the transmitter, from the time-sequential signal reconstituted at the receiver, thereby decrypting this signal and making the clear speech signal available at the receiver.

For further details reference is made to the following description, in the light of the accompanying drawings, wherein.

Figure 1:
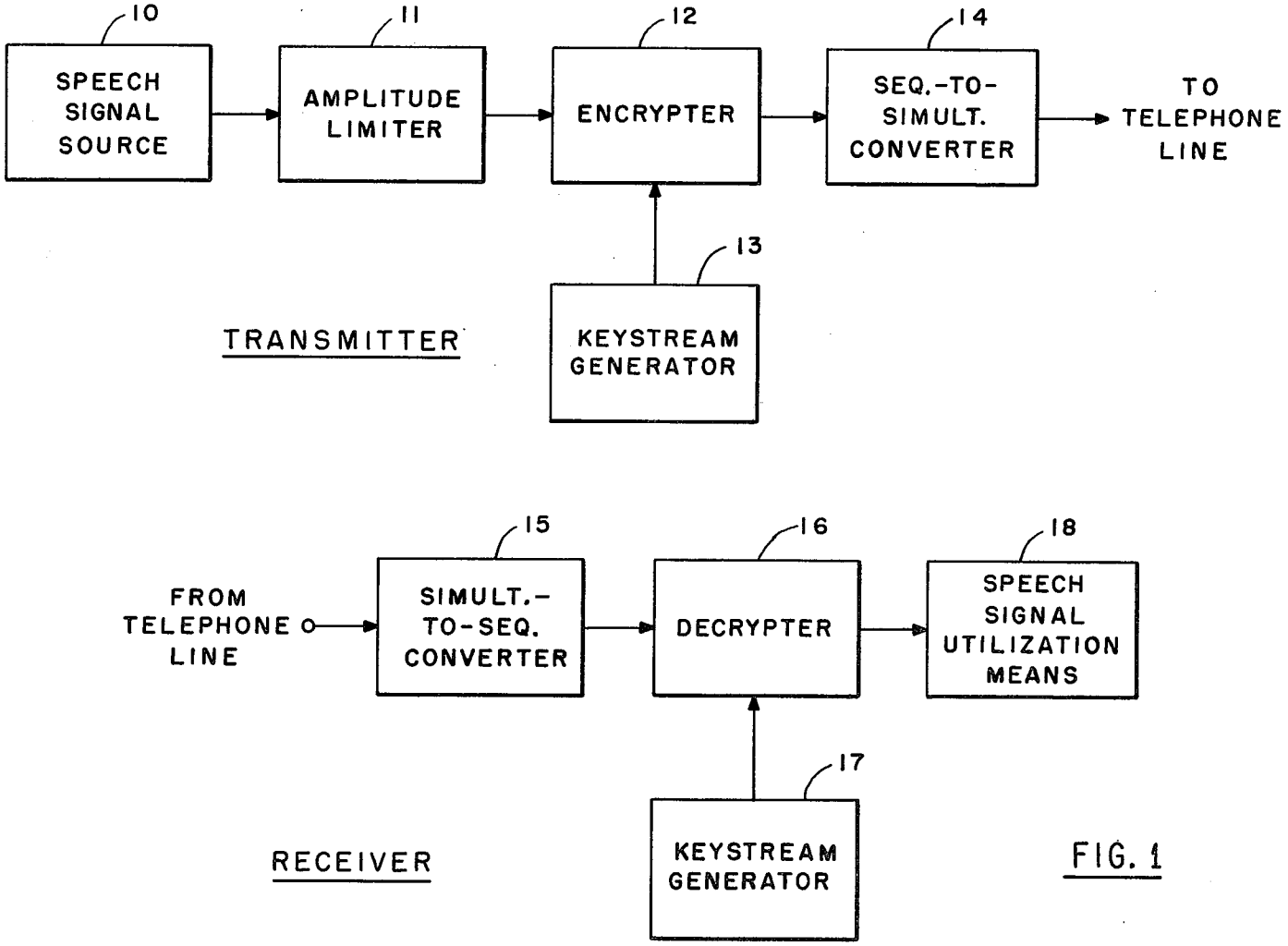
FIG. 1 is an over-all block diagram of an embodiment of the invention.
Figure 3:
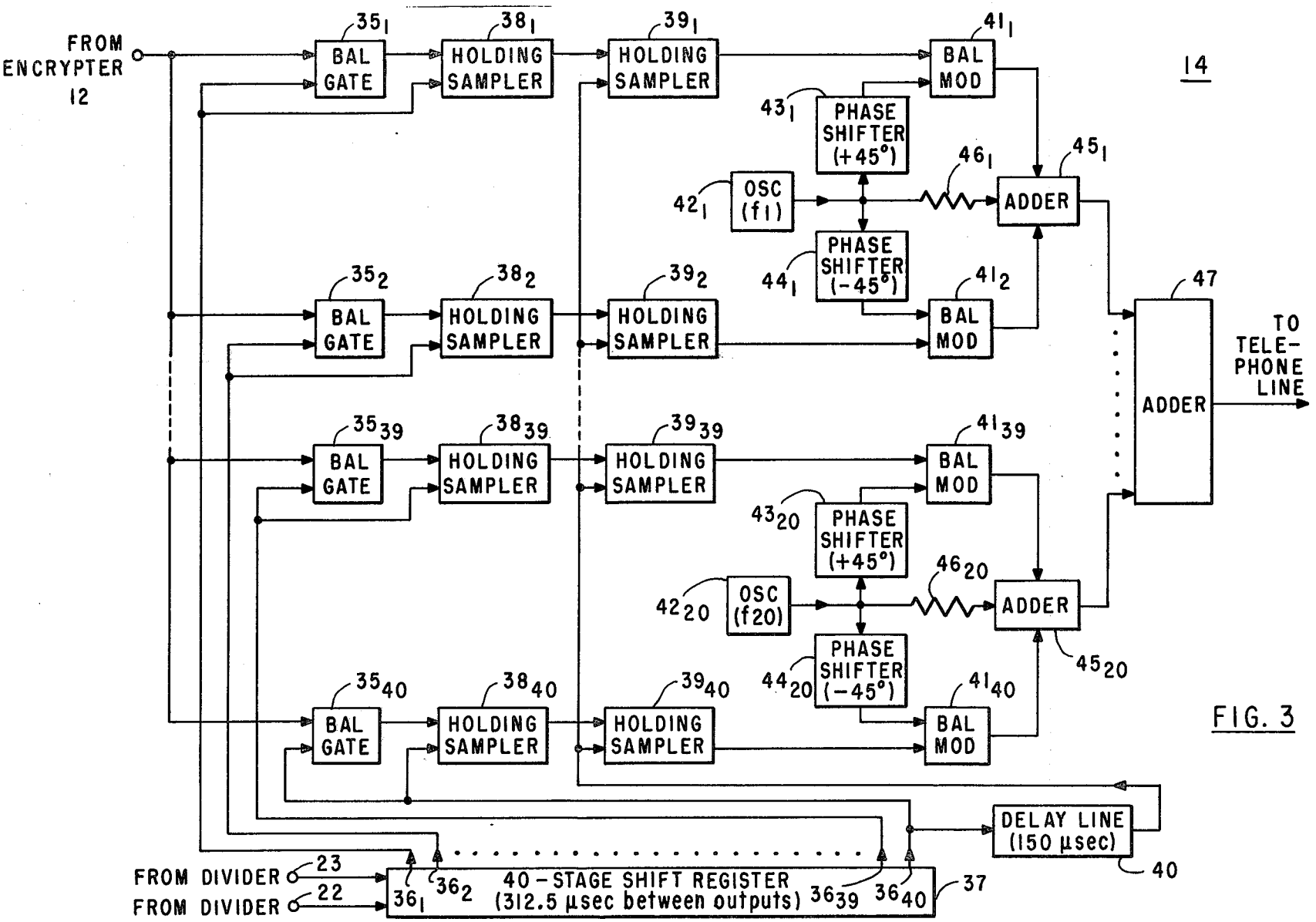
FIG. 3 is a diagram showing another block of FIG. 1 in more detail.
Figures 4A, 4B, 4C, 4D:
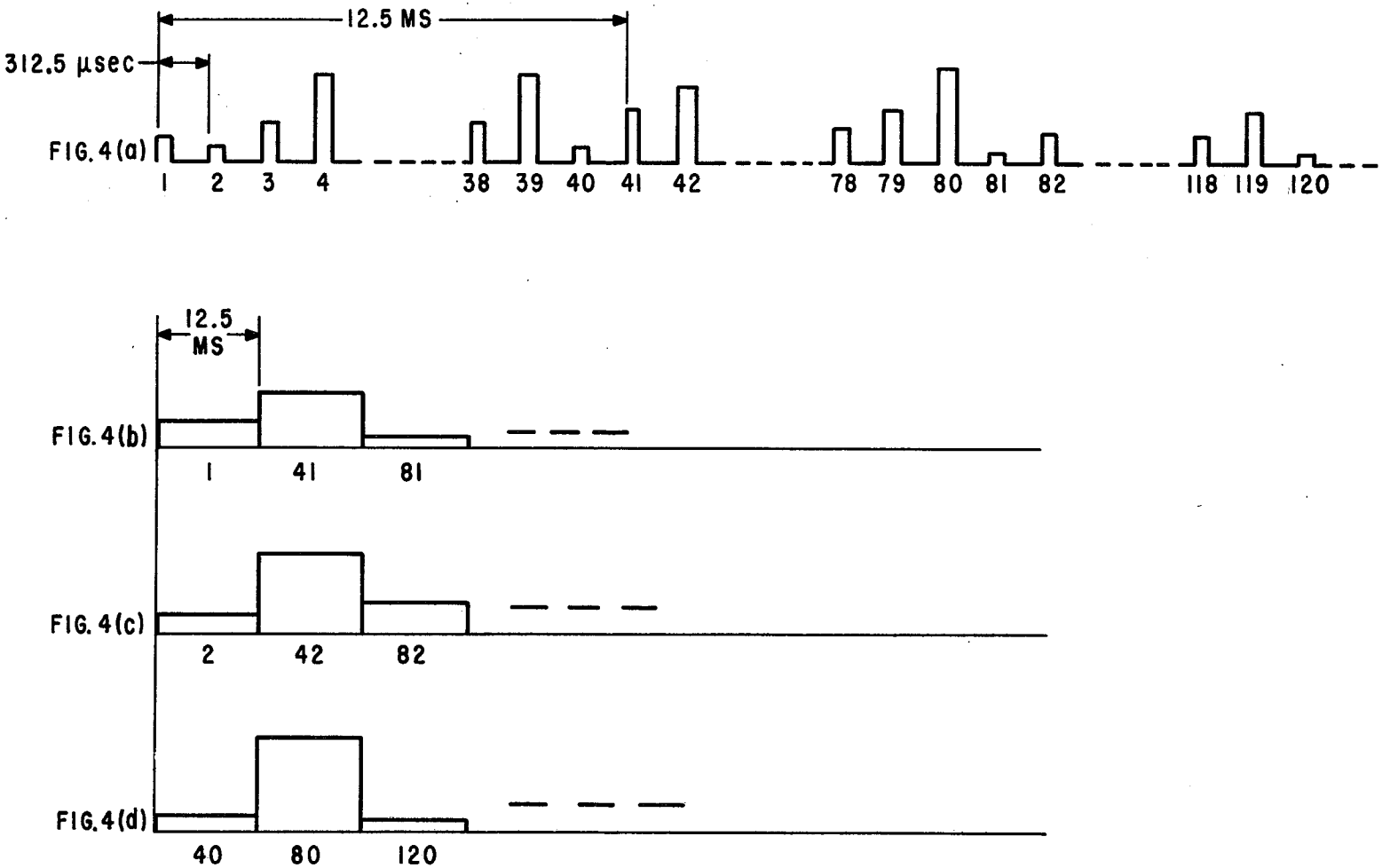
Figure 5:
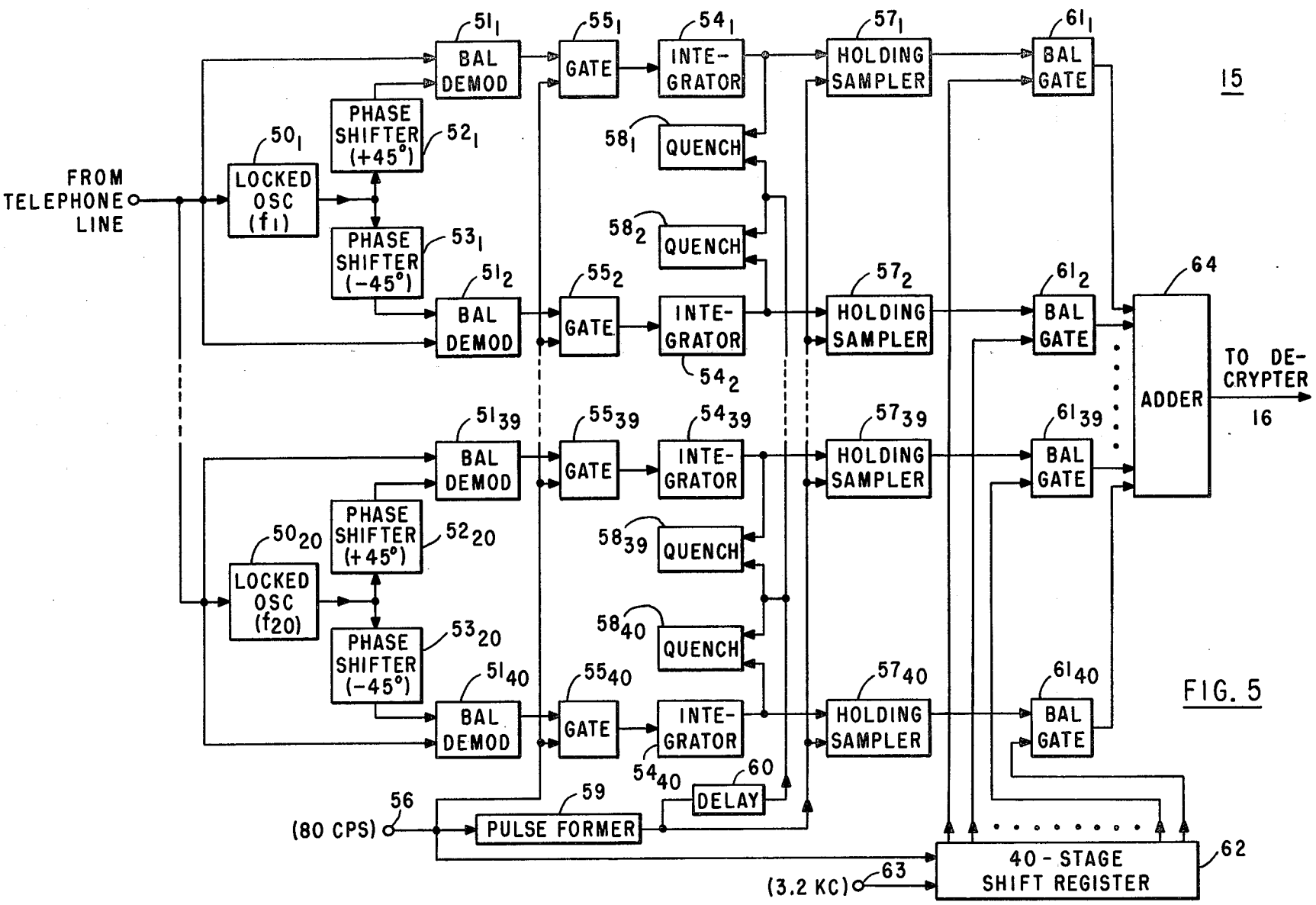

FIGS. 4*a*–4*d* are diagrams showing the relation between the signals at different stages within the apparatus of FIGS. 1 and 3; and FIG. 5 is a diagram showing still another block of FIG. 1 in more detail.

Throughout the drawings similar reference numerals are used to identify similar components. Where similar components appear in the same figure, different subscripts are used to distinguish them from each other.

Referring now to FIG. 1, the apparatus shown therein comprises a conventional source 10 of electrical signals representing speech. The output from this source 10 is supplied to an amplitude limiter 11 which may be of any conventional form capable of limiting the amplitude excursions of the electrical signal from source 10 to certain maximum values. The setting of the level at which this limiter exerts its amplitude limiting effect is discussed in more detail hereinafter.

The output signal from amplitude limiter 11 is supplied to an encrypting circuit 12 in which it is suitably combined with a signal, called a "keystream" signal, from a conventional generator 13 of such a signal. The keystream signal consists of an endless series of signal portions having a characteristic which varies substantially randomly from one portion to the next. In encrypting circuit 12 this keystream signal is added in modulo r fashion to the signal from amplitude limiter 11. Preferably r is some integral number substantially greater than 2, such as 64, and the units in which it is expressed are then each equal to one sixty-fourth of the maximum possible value of said randomly varying keystream signal characteristic. For example, if the randomly varying characteristic of the keystream signal is its amplitude, and if this amplitude has a maximum possible value of 64 volts, then the units of r are equal to one volt each. Prior to this addition in modulo r fashion the intelligence signal has, of course, been transformed, also within encrypting circuit 12, to the extent necessary to put it in a form in which it consists of successive portions in which that same characteristic varies in accordance with speech information which, in the keystream signal, varies in random manner. Specific forms of apparatus suitable for use as encrypting circuit 12 are described later in this specification. Encrypting circuit 12 also includes apparatus which converts the encrypted signal further to the extent necessary so that at the output of encrypting circuit 12 it is in the form of an amplitude varying signal having successive portions whose amplitudes represent respectively the modulo 64 sum of the amplitudes of successive portions of the speech and keystream signals.

The output signal from encrypting circuit 12 is supplied to a signal converting circuit 14 in which the different consecutive signal portions in successive groups or frames of forty are utilized to modulate forty different carrier waves in amplitude. These different carrier waves are in twenty pairs, the members of each pair being at the same frequency but at different phases and the different pairs being at different frequencies within the telephone line transmission band. Each carrier wave is modulated by a particular signal portion during the entire period occupied by forty consecutive signal portions in the output signal from encrypting circuit 12, i.e. during one whole frame period. Moreover, the modulation periods are aligned so that those corresponding to all forty signal portions in one frame begin and end simultaneously. Thus, the sequential signal portions of comparatively short duration produced by encrypting circuit 12 are transformed in converting circuit 14 into simultaneous carrier bursts of comparatively long duration, whose respective amplitude modulations represent the amplitudes of the different sequential signal portions. These simultaneous carrier wave bursts are all applied to the telephone transmission line, which may be of any completely conventional type and is therefore not illustrated in FIG. 1. At the receiver terminal of the system embodying the invention the signal arriving from the transmitter via this conventional telephone line is supplied first to a converting circuit 15 which performs on it an operation which is the inverse of that performed by converting circuit 14. More particularly converting circuit 15 receives the simultaneous carrier bursts from the telephone line and transforms them into a signal having time-sequenced portions respectively corresponding to the different simultaneous carrier wave bursts. These time-sequenced portions constitute essentially a replica of the time-sequential signal portions supplied at the transmitter from encrypting circuit 12 to converting circuit 14.

The output signal from converting circuit 15 is supplied to a decrypting circuit 16, to which is also supplied the output signal from the keystream generator circuit 17. This keystream generator circuit 17 may be identical to, and synchronized in its operation with the keystream generator 13 employed at the transmitter. Decrypting circuit 16 performs the operation of subtracting in modulo 64 fashion the signal from keystream generator 17 from the signal from converting circuit 15, thereby producing, at the output of decrypting circuit 16, a signal which is essentially a replica of the input signal to encrypting circuit 12 in FIG. 1. This output signal from decrypting circuit 16 is then supplied to a utilization device 18, which may be any conventional type of device capable of utilizing a conventional speech representative intelligence signal.

Figure 2:
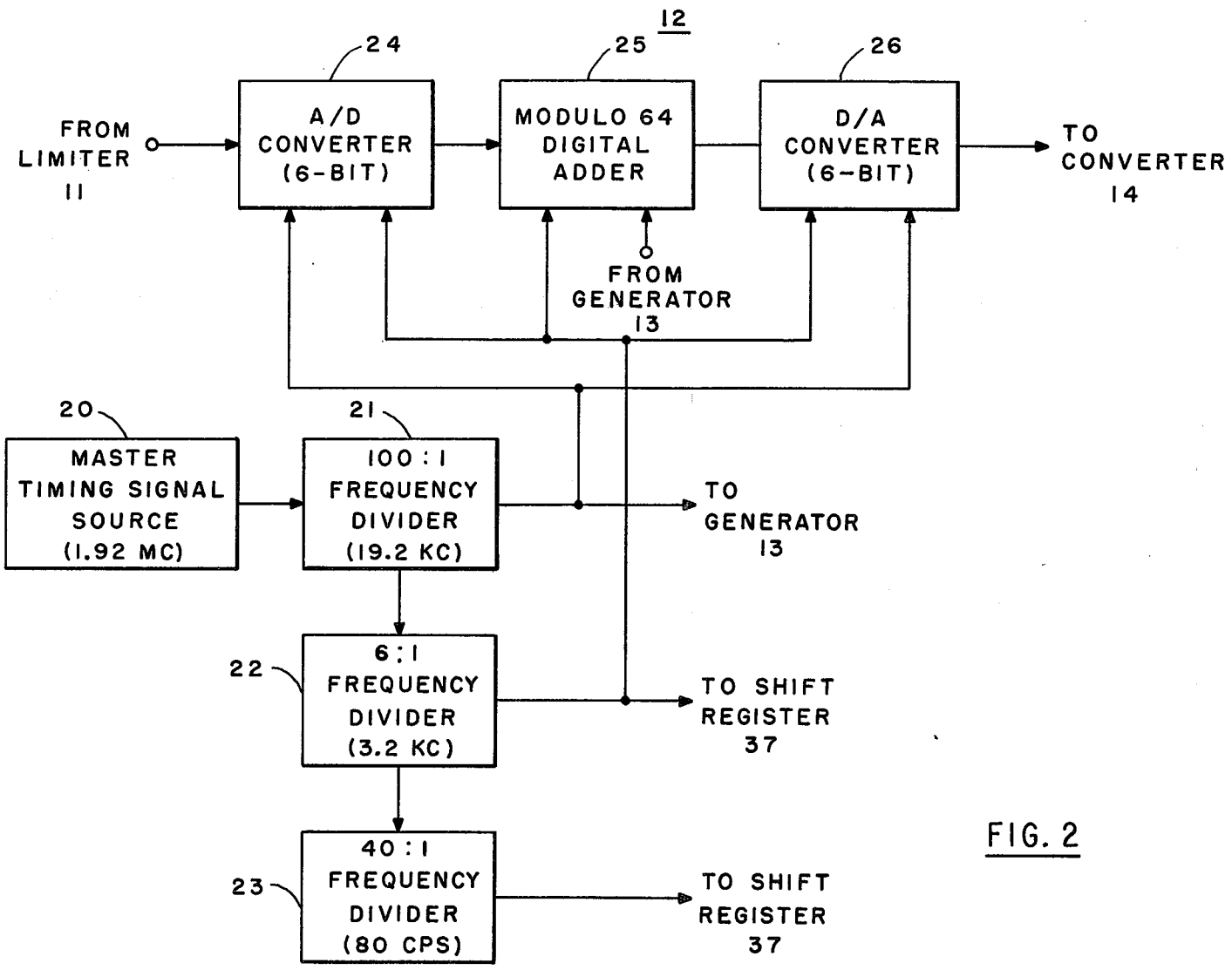
FIG. 2 is a diagram showing one of the blocks of FIG. 1 in more detail.

FIG. 2, to which reference may now be had, shows one possible form of the encrypting circuit 12 of FIG. 1. This apparatus comprises a master timing source 20 productive of pulses at a repetition rate of 1.92 megacycles. This source 20 may be of any conventional form consisting, for example, of a precision crystal oscillator and a conventional pulse shaping circuit for forming the output of the oscillator into pulses. The output pulses from source 20 are supplied in succession to three frequency dividers 21, 22 and 23, which divide their frequency successively by 100, 6 and 40 to produce at their respective outputs, pulses having repetition rates of 19.2 kc, 3.2 kc and 80 cycles per second. The 19.2 kc and 3.2 kc output signals from frequency dividers 21 and 22 are both supplied to a conventional 6-bit analog-to-digital, or "A/D" converter 24, to which is also supplied the amplitude-limited speech signal from amplitude limiter 11 of FIG. 1. A/D converter 24 responds to the application of these signals to deliver at its output binary digits, or "bits" at a 19.2 kc rate. Successive groups, or "words" of six consecutive bits, which occur at 3.2 kc rate, represent the amplitude of consecutive samples of the signal from limiter 11 taken at the same 3.2 kc rate and each quantized to the nearest one of the group of quantization levels so chosen relative to the amplitude variations of the speech signal that if this signal had not been amplitude limited in limiter 11 it would be capable of filling a maximum of 64 such levels. It will be recognized that a 6-bit digital word is capable of representing all of these different possible quantization levels by different ones of its possible combinations of "ones" and "zeros". Moreover, the sampling and quantizing operation discussed above is a recognized step in the transformation of an analog signal, such as the speech signal supplied to converter 24 in FIG. 2, into a corresponding digital signal, and the apparatus for performing the same therefore forms a conventional part of an A/D converter. The digital signal from A/D converter 24 is supplied to adding circuit 25, to which is also supplied a keystream signal from generator 13. This keystream signal may be a digital signal consisting of an endless series of ones and zeros occurring in a more or less random sequence.

Apparatus for producing such a signal may comprise a conventional shift register, plus circuits of varying complexity for providing feedback interconnections between different stages of this register. The greater the complexity of the feedback connections, the more nearly random the sequence of ones and zeros in the output signal and the more secure the encryption. One form of apparatus suitable for the above purpose is shown in FIG. 4 on page 559 of the March, 1958 issue of the Proceedings of the IRE, within the portion enclosed in the broken-line rectangle labeled "Shift Register". As explained in the description of this apparatus appearing on the same page of said publication, it puts out a binary digit sequence at the rate determined by the input timing signal. In the case of keystream generator 13 the required timing signal is the 19.2 kc output signal from frequency divider 21. As a result the keystream signal from generator 13 has the same bit rate as the signal from A/D converter 24, and the two signals are therefore suitable for digital addition to each other. The keystream signal described above may be regarded as consisting of successive six-bit digital words, corresponding respectively to successive ones of the six-bit words constituting the digital speech signal produced by converter 24. In accordance with the invention, words from the two different digital signals are added in adding circuit 25 in modulo 64 fashion. In terms of binary arithmetic the modulo is usually expressed as a power of 2, which means that modulo 64 would be expressed as modulo $2^6$. Modulo 64 (or modulo $2^6$) addition of digital signals is carried out by adding the digits of each word with "carry" from one place to the next for the six successive bits constituting the word, but not beyond. Thus in a continuous bit stream such as constitutes each of the signals added in circuit 25, there would be carry from one bit to the next for six consecutive bits but none from the 6th to the 7th bit. In practice the operation described above may be performed by a conventional digital adding circuit, such as that shown in FIGS. 13–36 on page 421 of "Pulse and Digital Circuits", by J. Millman and H. Taub, published 1956 by McGraw-Hill Book Company, Inc., New York, 1956, modified only to the extent of inhibiting carry for every sixth bit. This inhibition may be accomplished conveniently by utilizing the 3.2 kc signal from frequency divider 22 in FIG. 2 to ground the carry connection within the adding circuit periodically at a 3.2 kc rate.

The output signal from adder 25 of FIG. 2 represents the encrypted version of the original speech signal, in digital form. This signal is supplied to a conventional six-bit digital-to-analog, or "D/A" converter 26, which transforms it back into the form of an analog signal, differing from that supplied to converter 24 from limiter 11 both in that it is encrypted and in that it is in the form of quantized pulses. A typical form of this signal is shown in FIG. 4(*a*) in which successive ones of the pulses produced at the output of D/A converter 26 are illustrated. As indicated by the identifying numerals below the abscissa, which represents time, 120 successive pulses are diagrammatically illustrated in FIG. 4(*a*). The interval from one of these pulses to the next is 312.5 microseconds, which is the reciprocal of the 3.2 kilocycle frequency at which the original signal from limiter 11 is sampled for purposes of analog-to-digital conversion. Forty consecutive pulse samples constitute a frame. Each frame occupies a time period 40 times as long as one pulse-to-pulse period, i.e. a period of 12.5 milliseconds, which is the reciprocal of the 80 cycle per second frequency of the signal produced by frequency divider 23 in FIG. 2.

One possible form of circuit 14 in FIG. 1 is shown in detail in FIG. 3, to which reference may now be had. In this circuit, each frame of forty successive encrypted speech signal samples produced by encrypting circuit 12, as previously explained, is converted into a corresponding group of forty concurrent carrier waves, each having an amplitude corresponding to that of one of said samples, and each occupying a time interval substantially as long as the entire frame interval.

To this end the signal from encrypting circuit 12 (FIG. 1) is supplied in FIG. 3 to each of forty balanced gating circuits 35 of conventional form. For simplicity of illustration, only four of these circuits, designated by reference numerals $35_1$, $35_2$, $35_{39}$, and $35_{40}$ respectively are shown in FIG. 3. Different ones of gating circuits 35 are supplied, from different output terminals 36 of a 40-stage shift register 37, with gating pulses to which they respond to pass the concurrently applied portion of the signal from encrypting circuit 12 (FIG. 1). The shift register 37, which may be of any conventional form, is supplied with timing pulses at a 3.2 kc rate from frequency divider 22 of FIG. 2 and with timing pulses at a 80 cps rate from frequency divider 23 of FIG. 2. The shift register responds to these timing pulses to produce output pulses at a 3.2 kc rate at its different output terminals 36. The pulses produced at any given output terminal recur at a 80 cps rate. Thus the different samples in each frame pass through different ones of balanced gating circuits 35, while samples occupying the same relative positions in different frames pass through the same gating circuit 35.

The output from each balanced gating circuit 35 is supplied to a separate sampling and holding circuit 38, which may be of any conventional form such as, for example, that illustrated in FIG. 5-40 on page 5-63 of "Notes on Analog-Digital Conversion Techniques" edited by Alfred D. Susskind and published 1957 by John Wiley & Sons, Inc., New York, N. Y. Each of these circuits 38 is gated in conventional fashion by the same pulse from shift register 37 as the balanced gating circuit 35 whose output signal it receives. Consequently each circuit 38 stores each signal sample passed by the corresponding circuit 35 and in effect stretches it over one whole 12.5 millisecond frame period.

It will be understood that at this stage in the circuit of FIG. 3 the forty different stretched signals produced by the different sampling and holding circuits in response to the forty sequential pulse samples in any given frame have starting and ending times which are mutually displaced by the 312.5 microsecond pulse-to-pulse interval in the sequential signal from which they are derived. However, there is a period of overlap, which occurs during the last of the forty pulse-to-pulse intervals of each frame, during which all forty stretched signals derived from the sequential pulse samples in that frame are present simultaneously in the different sampling and holding circuits 38. During each such overlap period, all of these stretched signals are sampled simultaneously, by means of the forty different sampling and holding circuits 39 to which the outputs of the different sampling and holding circuits 38 are respectively supplied. Circuits 39, which may be identical in form to circuits 38, are also supplied with gating pulses. However, unlike the sampling pulses supplied to sampling and holding circuits 38, which are sequential, those supplied to sampling and holding circuits 39 are simultaneous, being derived, once in every 12.5 millisecond frame period, from the final output terminal $36_{40}$ of shift register 37, via delay line 40 which delays them by 150 microseconds. These simultaneous sampling pulses cause the output signals from circuits 38 to be transferred to circuits 39 where they are again effectively stretched over an entire 12.5 millisecond frame period. Thus, at the outputs of the different sampling and holding circuits 39, there are produced forty signals, corresponding respectively to different ones of the sequential samples in a frame of forty supplied from encrypting circuit 12 of FIG. 1. At the outputs of circuits 39 these different signals are present simultaneously and each exists for a period substantially equal to that occupied by the forty corresponding sequential samples.

The output signals produced in response to the pulse samples shown in FIG. 4(*a*) by three typical holding and sampling circuits 39 in FIG. 3, namely circuits $39_1$, $39_2$ and $39_{40}$, are shown to a common time scale in FIGS. 4(*b*), 4(*c*) and 4(*d*), respectively.

As shown in these figures, the signals corresponding to the pulse samples numbered 1, 41 and 81 in FIG. 4(*a*) appear in succession at the output of circuit $39_1$, with each signal extending over a period of 12.5 milliseconds, which is as long as the period occupied by all forty of the sequential pulse samples 1 through 40 in FIG. 4(*a*). Signals corresponding to pulse samples 2, 42 and 82, and similarly extending over 12.5 millisecond (ms) periods, appear in succession at the output of circuit $39_2$, while signals corresponding to pulse samples 40, 80 and 120 appear similarly at the output of circuit $39_{40}$. These output signals from circuits 39 are supplied, respectively, to separate balanced modulating circuits 41, to which are also supplied the output signals from oscillators 42. Whereas there are 40 balanced modulators in the circuitry of FIG. 3, there are only half as many, i.e. 20 oscillators 42. These oscillators may be of any conventional form, preferably differing from each other only in that they produce signals at 20 different frequencies, all within the pass-band of a conventional telephone line. The output from each oscillator is put through two conventional phase shifting circuits, of which one, designated 43 in FIG. 3, shifts the phase of the oscillator signal by 45° in one direction, while the other, designated 44 in FIG. 3, shifts the phase of the same signal by 45° in the opposite direction.

Thus the signals supplied from any one oscillator 42 to two of the balanced modulators 41 are mutually in phase quadrature. The pairs of quadrature-phased oscillator signals produced in this manner are amplitude modulated by the simultaneous, stretched signals produced by the various sampling and holding circuits 39 as previously explained. Modulators 41 are preferably balanced with respect to both input signals, so that only the modulation products appear in the outputs of the modulators, while both input signals are suppressed.

The output signals from each pair of modulators 41 operating on a common oscillator signal are combined in a separate adding circuit 45, whih may be of any conventional form. Also supplied to each adding circuit by means of a simple resistive load 46 is the unmodulated output signal from the corresponding oscillator 42, which is combined in the adder with the modulated signals.

The output signals from all twenty adding circuits 45 are supplied to a common adding circuit 47, of any conventional form, where they are all additively combined with each other for application to the conventional telephone line by means of which they are conveyed to the receiver.

Turning now to the receiver portion of the system of FIG. 1, the simultaneous-to-sequential signal converting circuit 15, to which the signal received from the telephone line is applied, performs on this signal essentially the inverse of the operations performed by the sequential-to-simultaneous signal converting circuit 14 at the transmitter.

To this end circuit 15 may comprise twenty oscillators 50, each supplied with the signal from the telephone line. Two typical oscillators 50 are shown in FIG. 5, to which reference may now be had. These oscillators may be of any conventional form, respectively capable of locking in frequency and phase to different ones of the unmodulated output signals from oscillators 42 of FIG. 3 which are present in the composite signal reaching the receivers via the telephone line.

The signal from the telephone line is also supplied simultaneously to each of forty demodulators 51, of which four typical ones are illustrated in FIG. 5. Each oscillator 50 supplies its output signal to two demodulators 51, via a +45° and a −45° phase shifting circuit 52 and 53, respectively. The demodulators 51, which may be of any conventional form and are preferably doubly balanced, respond to the respective applied oscillator signal and the signal from the telephone line to demodulate the amplitude variations of the different carrier wave components of the latter signal. Thus, at the outputs of the different demodulators 51 there are reproduced substantially the same signals which are supplied in FIG. 3 to the balanced modulators 41 from the different sampling and holding circuits 39 of FIG. 3, i.e. signals of the form shown in FIGS 4(*b*)–(*d*). The different demodulator output signals are supplied to different integrating circuits 54 via separate gating circuits 55. Both the gating circuits and the integrating circuits may be of any conventional form. The former are all supplied simultaneously with a gating signal from terminal 56. This gating signal consists of a series of gating pulses recurrent at a 80 cps rate and each slightly less than one frame, e.g. about 10 milliseconds, in duration. These pulses therefore occur at the same rate as successive portions of the output signals produced by the demodulators which represent different ones of the signal portions shown in FIGS. 4(*b*)–(*d*). The timing of the gating pulses in FIG. 5 is such that the center portions of successive ones of said demodulator output signal portions are passed by the gating circuits while the leading and trailing edges are not. Thus the integrating circuits 54 operate only on the center portions of the successive frame-long signal portions produced by the demodulators. This virtually eliminates delay distortions which may have been introduced into the received signal by the narrow-band properties of the telephone line, since such distortions affect primarily the edges of the successive demodulator output signal portions.

Each integrating circuit 54 integrates over one frame period the signal supplied to it through the associated gating circuit 55 and is quenched, or discharged, at the end of this period. This quenching is accomplished by means of conventional quenching circuits 58, of which one is provided for each integrating circuit 54. A suitable form of integrating and quenching circuits is described on page 565 of the above-identified issue of the Proceedings of the I.R.E. in paragraph "E". The quenching function of circuits 58 is controlled by pulses occurring at a rate of 80 per second and derived from terminal 56 via pulses forming circuit 59 and delay line 60.

In any one of demodulators 51 there may be produced, in addition to the desired demodulation signal, one or more undesired signals due to beats between the carrier wave intended to be demodulated thereby and other carrier waves intended to be demodulated by other demodulators. The unwanted contribution which these undesired signals make to the outputs of integrating circuits 54 will be a minimum when the period over which each integration effectively takes place is an integral multiple of one whole cycle of the undesired beat signal. This will occur if the frequency of each carrier wave employed in the system differs from that of every other such carrier wave by an integral multiple of the reciprocal of the effective integration period. This, therefore, is the preferred spacing between said carrier wave frequencies.

Sampling and holding circuits 57 receive the integrated signals from circuits 54 immediately before quenching, under control of gating pulses from the input to delay line 60. Holding circuits 57 effectively stretch the signal samples thus supplied to them so that, at the outputs of circuits 57, these signals extend substantially over a whole 12.5 millisecond frame interval. Balanced gating circuits 61, which are connected respectively to the outputs of the different sampling and holding circuits 57, sample these stretched signals in rapidly recurring succession. More particularly, each stretched signal is sampled once during its 12.5 millisecond period of existence and the stretched signals from the different circuits 57 are sampled at a 3.2 kc rate. This sampling is accomplished under control of sampling signals produced at the appropriate times by means of 40-stage shift register 62 which is actuated by the signal from terminal 56 and a suitable 3.2 kc timing signal from terminal 63.

The output signals from all the gating circuits 61 are supplied to adding circuit 64 where they are additively combined to produce a resulting signal essentially like that illustrated in FIG. 4(*a*), comprising sequential portions whose amplitudes correspond to those of simultaneously existing amplitude-modulated carrier waves in the telephone line.

This sequential signal produced by adding circuit 64 is supplied to decrypting circuit 16 of FIG. 1 where there is subtracted from it, in modulo 64 fashion, the same encrypting signal which was added, in modulo 64 fashion, in encrypting circuit 12 of FIG. 1.

Decrypting circuit 16 may be essentially similar to encyrpting circuit 12, differing from the latter only in that the arithmetical operation performed after A/D transformation of the received signal is that of subtraction, rather than addition of the keystream signal. The signal produced by this decrypting circuit 16 is substantially a replica of the unencrypted speech signal supplied to encrypting circuit 12 at the transmitter and may therefore be applied to any conventional speech signal utilization means 18 such as a loudspeaker, earphones, or the like.

The timing signals supplied to terminals 56 and 63 in FIG. 5, as well as the timing signals needed for the operation of decryption circuit 16 of FIG. 1, may all be derived at the receiver by means of suitable conventional frequency dividing circuits from a 1.92 mc oscillator (not shown) similar to that employed in master timing source 20 of FIG. 2.

Moreover the timing signals employed at the receiver may be established in the same relationships to the received intelligence signals which the timing signals employed at the transmitter bear to the transmitted intelligence signals by any conventional synchronization method. For example, at the beginning of each transmission, a brief period of a few seconds duration may be reserved for the transmission of synchronizing information, such as pulses corresponding to the timing of the 80 cps transmitter timing signals from frequency divider 23 of FIG. 2. These pulses may be compared with the 80 cps timing signals generated at the receiver and the result of the comparison employed in any one of a variety of known ways to control all the receiver timing signals to bring them into step with those received from the transmitter. Once synchronization is established it can readily be maintained, by use of sufficiently stable timing circuits, over the length of an ordinary telephone conversation. Alternatively, synchronization may be checked and reestablished, if necessary, repeatedly at predetermined intervals.

Also at the beginning of each conversation there is transferred from the transmitter to the receiver the information necessary to ensure that when decryption of the intelligence signal starts, the keystream signal used for description is the same as that used for encryption at the transmitter. This may be accomplished by establishing in the shift register intended for use in generating the keystream signal at the receiver the same pattern of ones and zeros which exists prior to the beginning of encrypted transmission in the shift register intended for use in generating the keystream signal at the transmitter. For this purpose there may be transmitted, immediately after transmission of the 80 cps synchronization pulses mentioned above, an additional set of pulses, also at a 80 cps rate and representing, respectively, the one or zero content of successive stages of the shift register in the transmitter keystream generator. These pulses are applied to the shift register in the receiver keystreamgenerator and are shifted through this register by 80 cps timing pulses until the register is filled. Thereafter a distinctive starting pulse is used to start the shift register at the transmitter running at its normal 19.2 kc rate, and the same pulse is transmitted to the receiver where it starts the shift register running at the same 19.2 kc rate.

As has been pointed out previously, in accordance with this invention the speech representative signal is processed at the transmitter (e.g. in amplitude limiting circuit 11 of FIG. 1) so that its maximum amplitude excursions are always substantially below the maximum amplitude of the keystream signal which is added to the speech signal for encryption purposes. The keystream signal may be either a digital signal as discussed above, or an analog signal similar to the speech signal and differing from the latter only in that successive portions have more or less random amplitudes rather than speech representative amplitudes. When the keystream signal is an analog signal, the significance of the above-mentioned limitation on speech signal amplitude is self-evident. On the other hand, when the keystream signal is digital, the significance of the requirement in question may not be self-evident and is therefore explained below.

As previously explained in describing FIG. 2, the encryption process utilizing a digital keystream signal involves the addition modulo $2^6$, of 6-bit portions of the keystream signal to a succession of speech representative, 6-bit digital "words". As is well known, the maximum number of discretely different amplitude levels of an analog signal (such as the original speech representative signal) which a 6-bit digital word is able to represent is sixty-four. This is the reason why the analog-to-digital conversion process which precedes the digital keystream addition involves a quantization of the original speech signal into 64 possible discrete amplitude levels. The 6-bit portion of the digital keystream which is added to each 6-bit digital word is likewise capable of representing a maximum of 64 discrete amplitude levels of an equivalent (though in practice non-existent) analog signal. The significance of the amplitude limitation under discussion is then that the amplitude of the analog speech signal shall be limited so that at least one, and preferably several of the highest of said 64 possible quantization levels are never occupied.

Many variations and modifications of the apparatus described above will occur to those skilled in the art. For example, the encyrption and decryption processes are not limited to addition at the transmitter and subtraction at the receiver, but any process of combination of intelligence and keystream signal may be used at the transmitter, provided the inverse process is used to eliminate the keystream signal at the receiver. The number of quantization levels, the number of digits in each digital word, the number of simultaneous signals at different frequencies and other parameters may be varied to suit different specific operational requirements. The amplitude limiting level may also be varied, its setting for any particular case representing a compromise between maximum freedom of the system from noise interference, which is achieved by setting narrow limits, and maximum ability to reproduce the full range of possible intelligence amplitude variation, which is achieved by setting the widest possible limits. Also encryption and decryption may both be carried out by means of analog keystream signals, in which case the A/D and D/A conversions described above in connection with the use of digital keystream signals become unnecessary. Instead the analog speech signal, in the form in which it is received from the amplitude limiting circuit 11 of FIG. 1, is added in modulo r fashion directly to the analog keystream signal. This keystream signal may be derived either from a digital keystream generator such as previously described by D/A conversion of successive 6-bit words of its bit stream, or directly from a suitable source of analog noise signals. In this case addition in modulo fashion is performed by first adding the analog keystream signal to the unencrypted analog speech signal in arithmetic fashion and then subtracting from their sum a signal equal to the maximum amplitude of the keystream signal, when, and only when said sum has an amplitude which exceeds said maximum amplitude. The value of the modulus in this arrangement is equal to the number of quantization levels of the analog speech signal which are possible within the maximum amplitude excursion range of the keystream signal. If there are 64 such levels, then the addition is modulo 64, the same as in the digital case described with reference to FIG. 2, above. If the analog signal is completely unquantized, this corresponds, in effect, to an infinite number of quantization levels and the addition is therefore modulo infinity. As has been explained, for the purposes of this invention the modulus is preferably much greater than 2, 64 being an adequately high number in practice.

The unmodulated carrier wave components received from the transmitter via the telephone line can also be used to perform additional functions beyond that previously described of locking the oscillators 50 of FIG. 5. Each of these components indicates, by its received amplitude, whether or not the modulated carrier wave components at the same frequency have been subject to attenuation or fading during transmission. They may therefore be used to carry out automatic gain control in conventional manner at one or more stages in the receiver to compensate for such attenuation. Moreover, if any of them should fall below a given threshold amplitude, indicating excessive attenuation of the corresponding modulated carrier wave components, this may also be detected in conventional manner and the resultant indication used to disable, for the duration of this conditiion, the receiver signal channels operating in response to these particular, excessively attenuated components. While these channels are thus disabled, their outputs may be supplied from adjacent receiver signal channels which have not been so affected. In this way, while excessive attenuation affects some portions of the received signal, these portions will be suppressed and replaced by approximations of the correct values of these portions derived from other portions of the received signal.

Also the original analog speech signal produced at the transmitter is subject to fluctuations in average level due to changes in speech volume. In a system in accordance with this invention which employs quantization of the analog signal the above changes reflect themselves as changes in the fineness of quantization and therefore as corresponding changes in the intelligibility and naturalness of the reproducd speech. This effect can be reduced by providing means at the transmitter which automatically compensate for variations in the average level of the speech signal, prior to amplitude limitation thereof. At the receiver, means should then be provided which produce the inverse effect, i.e. which restore the original variations in signal level. Apparatus for performing both of these functions is sometimes provided, for different reasons, in conventional telephone communication systems, where it is known collectively as a "compandor".

In view of these and other variations which may be made without departing from the inventive concept, we desire that concept to be limited only by the appended claims.

We claim:

1. In a secure communication system; means for producing an analog intelligence signal; means for limiting the amplitude of said signal; means for transforming portions of said amplitude limited signal occurring in time sequence into a corresponding digital signal consisting of sequentially occurring n-digit words; means for combining said digital signal with a digital keystream signal in modulo $2^n$ fashion; and means for transforming the digital signal produced by said combining means into an analog signal.

2. In a secure communication system; means for producing an analog intelligence signal; means for limiting the amplitude of said signal; means for transforming portions of said amplitude limited signal occurring in time sequence into a corresponding digital signal consisting of sequentially occurring n-digit words; means for adding said digital signal to a digital keystream signal in modulo $2^n$ fashion; and means for transforming the digital signal produced by said adding means into an analog signal.

3. In a secure communication system: means for producing an intelligence signal; means for limiting the amplitude of said signal; means for combining said amplitude limited signal with a keystream signal in modulo r fashion, said keystream signal being variable in the same characteristic as said amplitude limited signal and r being expressed in units of said amplitude; and means for utilizing successive portions of said combined signal to modulate the amplitudes of different carrier waves.

4. In a secure communication system: means for producing an intelligence signal; means for limiting the amplitude of said signal; means for adding modulo r where r is expressed in units of said amplitude said amplitude limited signal to a keystream signal variable in the same characteristic as said amplitude limited signal; means for utilizing time-spaced portions of said added signal recurrent at a predetermined periodicity to modulate a carrier wave of predetermined frequency and phase; and means for utilizing portions of said added signal intermediate said time-spaced portions and also recurrent at said predetermined periodicity to modulate, respectively, carrier waves differing from said first mentioned carrier wave in at least one of the parameters of frequency and phase.

5. In a secure communication system: means for producing an intelligence signal; means for limiting the amplitude of said signal; means for adding to said amplitude limited signal a keystream signal in modulo r fashion, said keystream signal being variable in the same characteristic as said amplitude limited signal and r being expressed in units of said amplitude; means for utilizing sequential portions of said added signal to modulate the amplitude of simultaneously occurring carrier waves, respectively, said carrier waves differing from each other in at least one of the parameters of frequency and phase; and means for transmitting all of said modulated carrier waves over a common transmission channel.

6. In a secure communication system: means supplied with an analog signal which is the modulo r sum where r is expressed in units of signal amplitude of an amplitude limited intelligence signal and a keystream signal variable in the same characteristic as said intelligence signal and responsive to said supplied signal to derive in separate channels, respectively, sequential portions of said supplied signal occupying a predetermined time period; means for stretching each of said signal portions to make all of them overlap in time; means for sampling all of said separate portions substantially simultaneously during said overlap; and means for utilizing the signal samples produced by said sampling means to control, respectively, the amplitudes of different carrier waves during concurrent intervals each substantially as long as said predetermined time period.

7. The apparatus of claim 6 characterized in that said utilizing means comprises means for stretching each of said signal samples over a period substantially equal to said predetermined time period, and separate modulating means respectively supplied with different ones of said last-mentioned stretched signal samples and different ones of said carrier waves.

8. The apparatus of claim 7 characterized in that each said modulating means is a modulator balanced with respect to both said signals supplied thereto.

9. The apparatus of claim 6 further comprising means for transmitting said controlled amplitude carrier waves over a common transmission channel, said channel having sufficient bandwidth to pass all of said carrier waves.

10. The apparatus of claim 9 characterized in that said carrier waves have frequencies which are equally spaced within said transmission channel bandwidth.

11. In a secure communication system: means for receiving a composite signal comprising a plurality of succcessive portions, each portion having a plurality of concurrent carrier wave components respectively modulated with different encrypted information; means for deriving from each said portion sequential signal portions respectively representing said different modulations; and means for combining a keystream signal in modulo r fashion with said derived signal, said keystream signal being variable in the same characteristic as said derived signal and r being expressed in units of said modulations.

12. In a secure communication system: means for receiving a composite signal comprising a plurality of successive portions, each portion having a plurality of concurrent carrier wave components respectively modulated with different encrypted information; means for deriving from each said portion of said signal sequential signal portions respectively representing said different modulations; and means for combining said derived signal in modulo r fashion where r is expressed in units of said modulation with a keystream signal variable in the same characteristic as said derived signal to eliminate from said derived signal those portions thereof representing said keystream signal.

13. In a secure communication system: means for receiving a composite signal comprising a plurality of successive portions, each portion having a plurality of concurrent carrier wave components respectively modulated with different encrypted information; means for deriving from each said portion of said signal sequential signal portions respectively representing said different modulations; and means for subtracting a keystream signal in modulo r fashion from said derived signal, said keystream signal being variable in the same characteristic as said derived signal and r being expressed in units of said modulations.

14. The apparatus of claim 13 further characterized in that said deriving means comprises means for separately demodulating each of said carrier wave components, means for separately integrating each of the demodulated signals produced by said demodulating means, means for stretching each of said integrated signals over a period substantially equal to that occupied by one of said successive portions of said composite signal, and means for sampling all of said stretched signals in succession during said period.

15. The apparatus of claim 14 further characterized in that said keystream subtracting means comprises a means for transforming each of said signal samples into a digital signal word and means for subtracting from said digital words a digital keystream signal in modulo $2^n$ fashion where n is the number of digits in each said word.

16. The apparatus of claim 15 further comprising means for transforming the output signal produced by said modulo $2^n$ subtracting means into an analog signal having sequential portions respectively representing the different digital words after said keystream signal subtraction.

17. In a secure communication system: means for producing an intelligence signal whose amplitude is capable of assuming various possible values; means for limiting the amplitude of said intelligence signal; means for deriving from said limited amplitude signal a signal having a characteristic which assumes different states for different ones of said values; means for producing a keystream signal having a characteristic which also assumes different ones of said states representing different possible ones of said values, said limiting means being effective to limit said amplitude so that said derived signal is precluded from assuming states corresponding to those states of said keystream signal which represent a plurality of the extreme ones of said possible values; and means for combining in modulo r fashion said derived signal with said keystream signal, r being expressed in the same units as said states of said signal characteristics.

18. In a secure communication system: means for producing an intelligence signal whose amplitude is capable of assuming various possible values; means for limiting the amplitude of said intelligence signal; means for deriving from said limited amplitude signal a signal having a characteristic which assumes different states for different ones of said values; means for producing a keystream signal having a characteristic which also assumes different ones of said states representing different possible ones of said values, said limiting means being effective to limit said amplitude so that said derived signal is precluded from assuming states corresponding to those states of said keystream signal which represent a plurality of the extreme ones of said possible values; and means for combining in modulo r fashion said derived signal with said keystream signal, r being an integer and being expressed in the same units as said states of said signal characteristics.

19. In a secure communication system: means for producing an intelligence signal whose amplitude is capable of assuming various possible values; means for deriving from said intelligence signal a signal having a characteristic which assumes different states for different ones of said values; means for adding to said derived signal a keystream signal in modulo r fashion, said keystream signal having a characteristic which also assumes different ones of said states representing different possible ones of said values, said deriving means comprising means for limiting said amplitude so that said derived signal is precluded from assuming states corresponding to those states of said keystream signal which represent a plurality of the extreme ones of said possible values, and r being expressed in the same units as said states of said signal characteristics.

20. In a secure communication system: means for producing an intelligence signal capable of assuming a variety of different amplitude levels; means for producing a keystream signal having successive portions representing different possible ones of said amplitude levels; means for processing said intelligence signal so as to prevent said processed signal from assuming a pluraity of the highest of said possible levels; and means for adding said amplitude limited signal to said keystream signal in modulo r fashion, where r is expressed in units of said amplitude levels.

* * * * *